United States Patent [19]

Fornataro

[11] Patent Number: 4,614,101

[45] Date of Patent: Sep. 30, 1986

[54] METHOD OF REWINDING SLIT METAL STRANDS

[75] Inventor: Augustine A. Fornataro, Callery, Pa.

[73] Assignee: Herr-Voss Corporation, Callery, Pa.

[21] Appl. No.: 326,187

[22] Filed: Dec. 1, 1981

[51] Int. Cl.[4] ..... B21D 1/02

[52] U.S. Cl. ..... 72/160; 72/203; 72/377; 242/56.1

[58] Field of Search ..... 72/160, 161, 163, 203, 72/204, 377; 242/56.2, 56.1, 56.7

[56] References Cited

U.S. PATENT DOCUMENTS

| | | | |
|---|---|---|---|
| 2,216,869 | 10/1940 | Yoder et al. | 72/203 |
| 3,552,175 | 1/1971 | Kinnavy | 72/296 |
| 4,173,313 | 11/1979 | Rogers | 242/56.2 |
| 4,201,352 | 5/1980 | Madachy | 242/56.2 |
| 4,286,451 | 9/1981 | Chang | 72/161 |
| 4,347,723 | 9/1982 | Bradlee | 72/203 |

FOREIGN PATENT DOCUMENTS

| | | | |
|---|---|---|---|
| 1415122 | 8/1973 | United Kingdom . | |
| 1543284 | 6/1975 | United Kingdom | 72/161 |

*Primary Examiner*—Daniel C. Crane

*Attorney, Agent, or Firm*—Buell, Ziesenheim, Beck & Alstadt

[57] ABSTRACT

Multiple strands of metal slit from strip which varies in thickness from edge to center are separately coiled on the same mandrel into uniformly tight coils by selectively working the strands so as to reduce the thickness and elongate thicker strands more than thinner strands. The working is preferably accomplished by imparting reverse bends to the strands while tensioning them in amounts less than the tensile yield strength of the metal.

5 Claims, 1 Drawing Figure

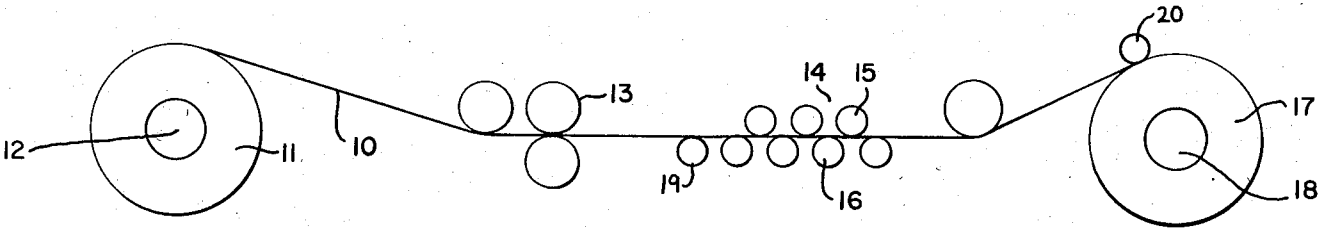
12
11
10
13
19
14
15
16
20
17
18

METHOD OF REWINDING SLIT METAL STRANDS

This invention relates to the rewinding of strands of metal slit from a coil. It is more particularly concerned with a process for rewinding into uniformly tight coils strands slit from strip varying in thickness from center to edge.

Narrow metal strip, for example, steel strip, is economically produced by slitting wider strip into multiple strands. This is done by passing the wide strip through a rotary slitter. The multiple strands resulting then must be rewound into coils, and this is conventionally done on a single mandrel, the adjoining coiled strands being spaced from each other. It is generally the case that the wide strip varies somewhat in thickness from edge to center, frequently being thicker at the center than at the edges. Thus, when multiple strands are coiled, the thicker strip builds up into a coil of larger outside diameter than coils of thinner strands, and the thinner strands, being under less tension than the thicker strands, sag between slitter and recoiler while the thicker strands stay taut. Loosely wound coils are frequently not acceptable by the customer because they cannot be properly handled in subsequent processing equipment.

Various expedients have been used for dealing with this problem. The most primitive method requires that an operator be stationed at the recoiler. As slack develops in a strand, he inserts small pieces of cardboard or other material between the approaching slack strand and the rewound coil, so as to increase its outer diameter to that of the tightly wound coils. This procedure is costly and is hazardous to the operator. A second method of recoiling slit strands of varying thickness employs a series of slip cores, one for each strand coil, which are placed on the mandrel and driven by friction in such a way that each core is driven by a relatively constant frictional torque at different speeds, thus permitting tension to be maintained on each slit strand as it is rewound. In this method, each slip core slips relative to the mandrel at a different rate, and to maintain tension on all strands, the recoiler is rotated at a speed faster than the rotational speed of the fastest rotating coil, which corresponds to the thinnest material. This method requires that the cores, usually made from cardboard, micarta, or steel, be accurately made and that they be positioned on the mandrel with great care. The means to provide frictional driving torque are usually a metal disc keyed to the mandrel against which a compressive force is applied by a pneumatically or hydraulically actuated cylinder. Means to keep the slit strands separated must also be provided. To avoid the need for such means, many applications of this method have utilized two or more rewind mandrels.

A third method to rewind slit strands of varying thickness also employs sleeves or hollow cores on which each slit strand is rewound; but, in contrast to the previous method, each sleeve is positively driven by the mandrel at the same rotational speed. The sleeves are not inherent to the process but are used to permit rewinding on very small mandrels and/or to facilitate subsequent handling of the slit coil. This method requires an exit tensioning device against which the driven sleeves can pull and a strip accumulation pit. The need for the pit arises from the increasing differences in the diameters of coils of thicker slit strands with respect to those of the thinner slit strands, as all strands are rewound at constant rotational speed in this method. Such pits are often over 100 feet in depth. They are expensive to build and to maintain. Further, elaborate provisions must be made to separate the strands as they emerge from the pit and to provide each strand with some initial tension before engaging the exit tensioning device.

The above mentioned methods in use prior to my invention to be described are makeshifts; and do not attack the basic problem, which is the difference in thickness between strands slit from the same coil.

It is an object of my invention to provide a process for rewinding slit metal strands of different thicknesses into uniformly tight coils that require no manual intervention. It is another object to provide such a process in which all the slit strands are rewound at the same rotational speed. It is another object to provide a process which prevents overlapping of adjoining strands. Other objects of my invention will appear in the course of the description thereof which follows.

In my process I slit metal strip from a coil which may vary in thickness across its width. The multiple strands so slit are recoiled on the same mandrel at the same rotational speed, spaced from each other. Between the slitting and the recoiling step I selectively work the strands so as to elongate and simultaneously thin out the thicker strands more than the thinner strands. Thus the strands tend to be recoiled into coils of uniform tightness. I preferably work the strands selectively by subjecting them to repeated reverse bending under tension less than the tensile yield strength of the metal.

The repeated bending reversals produce another desirable result, namely, additional back tension on all strands, with tension modulation of individual strands.

A schematic arrangement of apparatus adapted to practice an embodiment of my process presently preferred by me is illustrated in the attached FIGURE, to which reference is now made.

Strip 10 from a coil 11 mounted on a pay-off reel 12 is introduced into a conventional slitter 13 which slits it into multiple strands. Those strands are passed through a strand tensioning apparatus 14, comprising a plurality of parallel upper rolls 15, offset respectively in the direction of strand travel from a plurality of parallel lower rolls 16 but overlapping them in the path of strand travel so as to bend the strand downwardly and upwardly in reverse fashion as the strands pass through the rolls. Rolls 15 and 16 may be provided with back-up rolls to prevent roll bending. The multiple strands leaving tensioning device 14 are recoiled side-by-side on the same mandrel 18, into individual coils 17.

Strand separators 19 and 20 are located just ahead of the strand tensioning device and at the coiling reel respectively.

Tension in the strands between slitter 13 and recoiler mandrel 18 is a function of the current supply to the drive motors of the pay-off reel, slitter, and recoiler, the work of the slitting process, and the work associated with the repeated bending strain reversals.

While tension alone below the tensile yield strength of the metal will not elongate and thin the strands, tension in combination with repeated bending reversals of the strands can elongate them and reduce their thickness. All the strands pass between the same bending rolls, but the bending strain reversals produce a greater tension increase in the thicker strands than on the thinner strands. Furthermore, any increase in the diameter of the coils of thicker material will tend to impose additional tension on the thicker strands. The net effect is to elongate and thin the thicker strands relative to the thin, which is an object of this invention. It is desirable in dealing with the metal strip to work it with rolls of small diameter, in the neighborhood of $1\frac{1}{2}$ inches or so.

The necessary strand elongation and thinning during coil build-up are directly proportional to the thickness of the individual strands, as may be shown.

Let T=minimum strand thickness

Let T+t=maximum strand thickness

Let D=diameter of recoiler mandrel

Let N=number of turns of strands on mandrel

After N revolutions of the mandrel, the speed of the thickest material will be proportional to $$[D+2N(T+t)] \quad (1)$$

and the peripheral speed of the thinnest strand will be proportional to $$[D+2NT] \quad (2)$$

The ratio of these speeds is $$\frac{D+2N(T-t)}{D+2NT} = 1 + \frac{2Nt}{D+2NT}$$

When N is small, 2NT is small relative to D and the speed ratio differs from unity by only (2Nt)/D.

It is evident that by elongating the thicker strands by a slight amount, (2Nt)/D, the ratio of peripheral speeds of the coils of strands can be maintained very close to unity throughout the entire coil build-up. The elongation required will be small, because t/D is always very small, approaching 0 as t, the difference in thickness between the thickest strand thinnest strand, diminishes.

It is well known that when metal strip is subject to extension or elongation its thickness will be reduced correspondingly by 70% to 80% of the extension strain. Thus, if the thickest strand is elongated in the amount indicated by equation (3) above as the strand is rewound throughout the coil build-up, the strand will be continuously thinned, and the required magnitude of elongation will remain approximately (2Nt)/D. In fact, we may consider that as the coil builds up we have essentially an increasing net effective diameter so that the required elongation decreases.

In the foregoing specification, certain preferred embodiments and practices of this invention have been set forth; however, it will be understood that this invention may be otherwise embodied within the scope of the following claims.

I claim:

1. The method of coiling into uniformly tight coils multiple metal strands slit from strip varying in thickness from edge to center comprising working the multiple strands selectively by reverse bending between the same rolls, so as to reduce and elongate the thicker strands more than the thinner strands and then coiling the strands in multiple at the same rotational speed.

2. The method of claim 1 in which the thicker strands are worked to substantially the same thickness as the thinner strands.

3. The method of claim 1 in which the selective working comprises subjecting the strands in multiple to reverse bending while applying tension thereto less than the tensile yield strength of the metal.

4. The method of claim 3 in which the reverse bending is imparted to the strands by passing them in multiple between overlapping upper and lower rolls offset in the direction of strip travel.

5. The method of claim 3 in which the tension is adjusted so that the elongation of the thickest strand is substantially equal to (2Nt)/D where N is the number of turns of strand in a coil, t is the difference in thickness between thickest and thinnest strands and D is the inside diameter of a coil.

* * * * *